US006752255B2

(12) United States Patent
Lefeuvre

(10) Patent No.: US 6,752,255 B2
(45) Date of Patent: Jun. 22, 2004

(54) HANDRAIL-FORMING DEVICE FOR A HIGH-SPEED MOVING WALKWAY OR THE LIKE

(75) Inventor: Philippe Lefeuvre, 3, rue Victor Hugo 83140, Six Fours (FR)

(73) Assignee: Philippe Lefeuvre (FR)

( * ) Notice: Subject to any disclaimer, the term of this patent is extended or adjusted under 35 U.S.C. 154(b) by 0 days.

(21) Appl. No.: 10/266,417

(22) Filed: Oct. 8, 2002

(65) Prior Publication Data

US 2003/0066732 A1 Apr. 10, 2003

(30) Foreign Application Priority Data

Oct. 9, 2001 (FR) ..... 01 12989

(51) Int. Cl.[7] ..... B65G 43/00
(52) U.S. Cl. ..... 198/323; 198/334
(58) Field of Search ..... 198/323, 334, 198/338

(56) References Cited

U.S. PATENT DOCUMENTS 3,835,977 A * 9/1974 Hewitt et al. ..... 198/323
5,332,078 A 7/1994 Johnson
6,367,608 B1 * 4/2002 Franceschi ..... 198/335

FOREIGN PATENT DOCUMENTS

| | | |
|---|---|---|
| EP | 1 046 606 A | 10/2000 |
| GB | 2 255 951 A | 11/1992 |
| JP | 07 228466 | 8/1995 |

* cited by examiner

*Primary Examiner*—Joseph E. Valenza
(74) *Attorney, Agent, or Firm*—Harness, Dickey & Pierce, P.L.C.

(57) ABSTRACT

The device includes a protection and safety assembly which covers the downstream end of said device and which, in said decelerated safety zone, includes a moving member disposed above said handrail elements and adapted to be entrained by a foreign body itself entrained by said handrail elements in the same direction as and at the same speed as said handrail elements along a substantially horizontal path, and detector means adapted to detect predetermined displacement of said member in said direction, and to cause at least said device to stop.

9 Claims, 2 Drawing Sheets

47
31
35
34
32
38
39
32
36
22
37
25
18
23
26
33
40
L
41
45
III
III
15
24
21
15a 44
42
29
28
27
46
42a
30
24
1, 6
41a
41
23
43
26
28
27
30
45

46
40
42
42a
41a
41
33
1, 6
23
26
45

HANDRAIL-FORMING DEVICE FOR A HIGH-SPEED MOVING WALKWAY OR THE LIKE

The present invention relates to a handrail-forming device for a high-speed moving walkway or the like, said device being accelerated and decelerated respectively at its upstream end and at its downstream end.

BACKGROUND OF THE INVENTION

A handrail-forming device of the above-mentioned type is known for example from the Applicant's Document EP-A-1 046 606. That device comprises handrail elements organized such that the visible handrail elements that make up the top run of the device and that are moved in the downstream direction are moved at a decelerated speed in a decelerated safety zone which is situated upstream from and in the vicinity of the downstream end of said device, and in which said elements must be accessible to the public.

Downstream from said safety zone, the handrail elements pass through an acceleration and turn-around zone of said device, in which zone they are no longer accessible to the public.

For the safety both of the equipment and of the users of such a moving walkway or the like, it is essential to provide a safety device adapted to stop the handrail-forming device, and in general also the moving walkway, in the event that, for any reason, a foreign body, e.g. the hand of a user, hanging onto handrail elements is in danger of being entrained downstream from said safety zone.

SUMMARY OF THE INVENTION

An object of the present invention is to solve the problem posed and to provide a solution guaranteeing the safety both of the equipment and of the users.

It should be noted that this problem does not arise in conventional moving walkways that travel at a normal speed at which the handrails are neither accelerated nor decelerated at their ends, and in which they travel at a constant speed between two turn-around zones that are visible in part.

The downstream turn-around zone is situated at a place where the users have stepped off the moving walkway and can, if necessary, lean on the stationary balustrade of the walkway.

The safety member provided for the handrail is then installed at a place which is not directly accessible to the public, e.g. at the substantially vertical segment or at the horizontal segment constituting the upstream end of the return bottom run, along which the handrail disappears, after it has turned around, in the bottom portion of the walkway, and said safety member can be constituted merely by a safety switch of any type adapted to being actuated in the event that a foreign body goes past.

Such a member is not adapted to a handrail-forming device of the above-mentioned type.

In the present invention, the device of the above-mentioned type includes a protection and safety assembly which covers the downstream end of said device and which, in said decelerated safety zone, includes a moving member disposed above said handrail elements and adapted to be entrained by a foreign body itself entrained by said handrail elements in the same direction as and at the same speed as said handrail elements along a substantially horizontal path, and detector means adapted to detect predetermined displacement of said member in said direction, and to cause at least said device to stop.

Thus, as soon as a foreign body is entrained by the handrail elements into the safety zone, the moving member is entrained by said foreign body, and the displacement of said moving member is detected so that the device and the moving walkway are caused to stop.

In addition, like the handrail elements, the moving member moves along a substantially horizontal path, so that any incident is detected, and the device and, in general, the walkway are stopped well before the turnaround zone and well before the incident can have serious consequences for users.

In an advantageous version of the invention, said assembly includes actuator means for causing said member as entrained in this way by a foreign body to be moved in said direction at a speed higher than the speed of said foreign body.

This removes all risk of a foreign body or of the hand of a user being pinched between the moving member and the handrail elements.

In an advantageous version of the invention, the actuator means comprise means for exerting a force on the moving member in the direction in which the handrail elements move, the protection and safety assembly also including brake means adapted to maintain said member in its waiting position against the effect of said force, and to cease their braking action at least in part when a foreign body entrained by the handrail elements goes past.

The moving member, urged continuously by said force, is released as soon as the braking action is lower than said force, and thus constitutes a sub-assembly that moves with very low inertia, and that is capable of reacting very rapidly in the event of intrusion of a foreign body.

In a very advantageous version of the invention, the protection and safety assembly includes protection means disposed above said member to protect said member, and adapted to open up to allow said foreign body to pass through when it is entrained with some minimum force by said handrail elements.

Such protection means make it easy to head off or deflect objects that are merely deposited on the handrail elements but that are not fixed or coupled firmly to them, so as to avoid untimely stopping of the handrail-forming device of the present invention, while also guaranteeing full safety for the equipment and the users.

In a preferred version of the present invention, the protection means comprise two elastic lips that are substantially touching, extending longitudinally above said member in their closed position, and that are organized such that the respective adjacent edges of said two lips can move apart from each other transversely and upwards into a raised position to allow said foreign body to go past.

BRIEF DESCRIPTION OF THE DRAWINGS

Other features and advantages of the present invention appear from the following detailed description.

In the accompanying drawings, which are given merely by way of non-limiting example.

DETAILED DESCRIPTION OF THE PREFERRED EMBODIMENT

Figure 1:
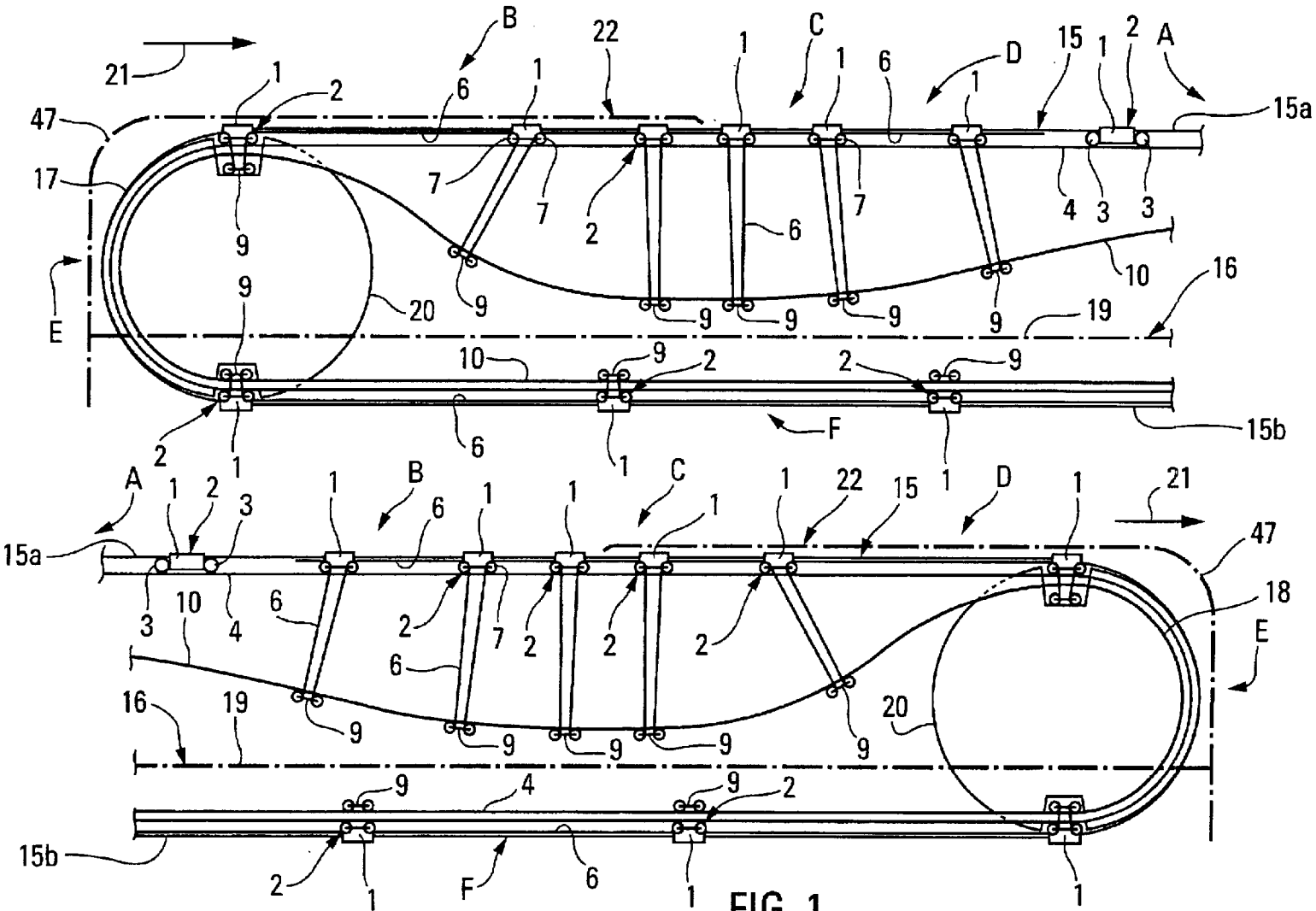
FIG. 1 is a fragmentary diagrammatic elevation view of a device according to an embodiment of the present invention.

FIG. 1 shows an example of a handrail-forming device 15 for a high-speed moving walkway 16 or the like. Said device is accelerated and decelerated respectively at its upstream end 17 and at its downstream end 18, which ends correspond to regions in which the high-speed moving walkway 16 has respectively an acceleration segment and a deceleration segment.

This handrail-forming device 15 is described in the Applicant's Document EP-A-1 046 606 whose contents are incorporated into the present application by way of reference.

This known handrail-forming device 15 comprises handrail handholds 1 mounted on respective carriages 2 whose wheels 3 move between rollway and guideway rails 4.

A link element 6 constituted by a flexible link interconnecting two successive carriages 2 by passing over two deflector members 7, e.g. pulleys, carried by the axles of the wheels 3 of the carriages 2 so that the flexible link element 6 folds over substantially at right angles facing each corresponding handhold 1.

The two ends of each flexible element 6 are connected to respective ones of two adjacent backing carriages 9 which are mounted to move on rollway and guideway rails 10 while being maintained by said rails 10 at a distance from the rollway and guideway rails 4 for the carriages 2 that varies so that the spacing between the handholds 1 varies, thereby varying their speed.

Each of the sides of the moving walkway 16 is equipped with a moving handrail 15.

In the zone A in which the handrail 15 moves at constant maximum speed, which zone covers most the walkway 16, and in which the moving floor 19 of said moving walkway also moves at a constant maximum speed, the backing carriages 9 meet the carriages 2 carrying the handholds 1 because the guideway rails 10 are very close to the rails 4 and the flexible link elements 6 are spaced apart in a manner such that the distance between two successive handholds 1 is at its maximum.

At each end 17, 18 of the handrail-forming device 15, each of the rails 4 for guiding the carriages 2 and each of the rails 10 for guiding the backing carriages 9 forms a loop to guide the carriages 2 and the backing carriages 9 about a turn-around device 20 for turning the handrail 15 around, making it possible to return the handholds 1 and link elements 6 from one end 17, 18 to the other end 18, 17 of the device 15.

The handrail-forming device 15 shown diagrammatically in FIG. 1 is a device that is totally reversible. For the purposes of the following description, it is assumed that the visible handrail elements, constituted by the handholds 1 and by the link elements 6, situated above the moving floor 19, and that constitute the top run 15*a* which is accessible to the users, are moved downstream in the direction indicated by arrow 21, from left to right in the figure, the upstream end 17 being situated on the left of the top portion of the figure, and the downstream end 18 being situated on the right of the bottom portion of the figure.

Because of this reversibility, both the upstream and the downstream ends 17, 18 of the device 15 are provided with protection and safety assemblies 22 of the type described below.

Naturally, a non-reversible handrail-forming device may be provided with one assembly 22 only, installed at its downstream end 18.

Between the constant maximum speed zone A and the downstream end 18, the handrail-forming device 15 comprises, in succession, a deceleration zone B corresponding substantially to a zone in which the moving floor 19 decelerates, and then a decelerated safety zone C. The decelerated safety zone C is generally situated in register with a decelerated zone of the moving floor 19. Downstream from the decelerated safety zone C, the users have stepped off the moving walkway 19 and no longer need a handrail that is moving, and they can lean on a stationary handrail or the like or on a cover covering the device 15.

In the example shown in FIG. 1, downstream from the decelerated safety zone C, the handrail-forming device 15 has an acceleration zone D followed by a turn-around zone E which forms the bottom run 15*b* for returning the handrail elements 1, 6 to the upstream end 17.

In the same way, at its upstream end 17 which receives the downstream end of the return bottom run 15*b*, the device 15 has a turn-around zone E followed downstream in the direction indicated by arrow 21 by a deceleration zone B, and then by a decelerated safety zone C, in which the handrail elements 1, 6 are accessible to the users. The decelerated zone C is followed by an acceleration zone D which gives access to the constant maximum speed zone A.

Figures 2, 3, 4:
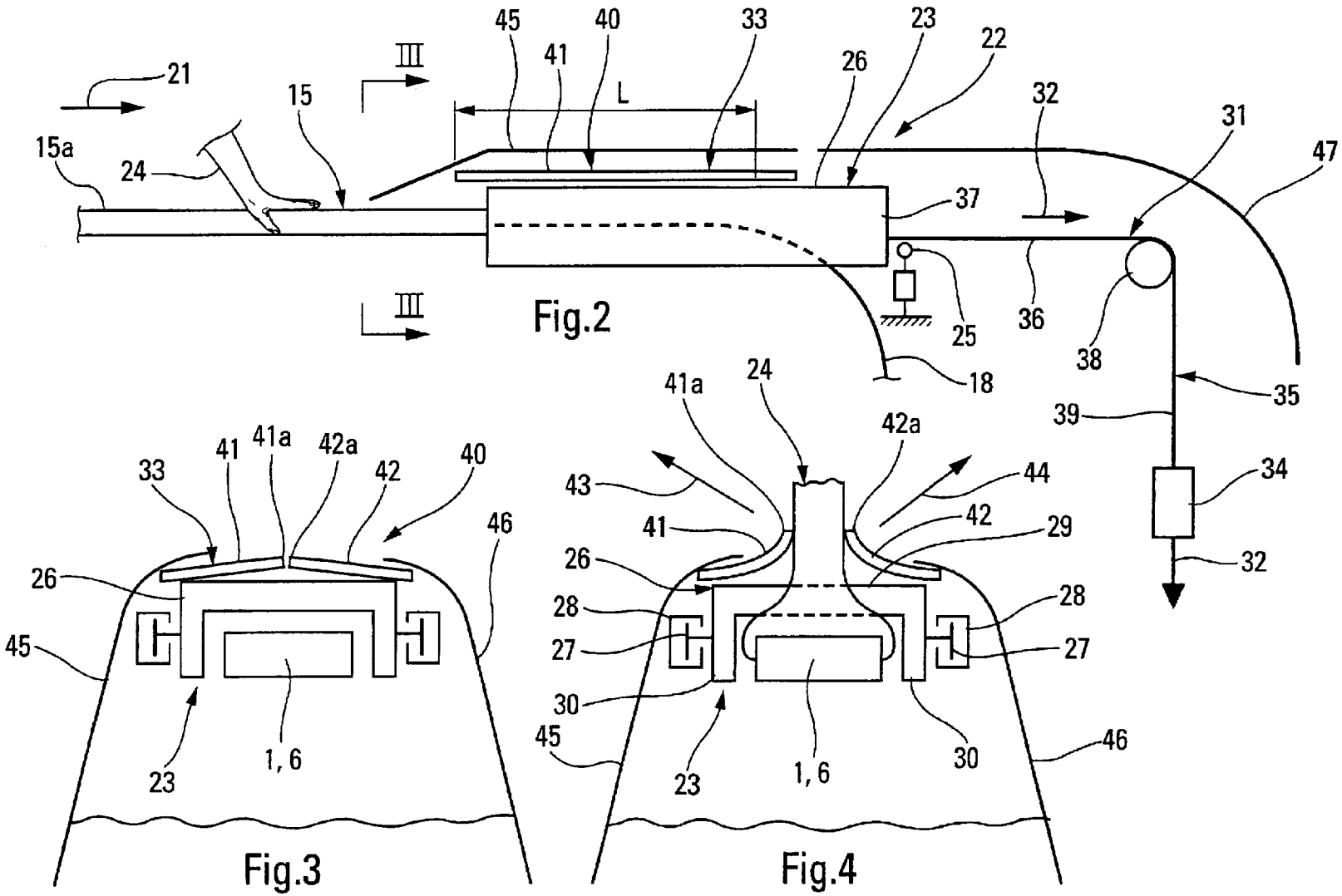
FIG. 2 is an enlarged diagrammatic view of a detail of FIG. 1, showing a protection and safety assembly according to an embodiment of the present invention.
FIG. 3 is a diagrammatic section view on III—III of FIG. 2.
FIG. 4 is a view similar to FIG. 3, showing the hand and the arm of a user engaged in the protection means of the device.

The following detailed description also applies when, as in the example shown in FIG. 3 of EP-A-1 046 606, the acceleration zone D and the turn-around zone E of the downstream end 18 substantially coincide.

The handholds 1 and the flexible link elements 6 are thus organized, and the rails 10 guiding the backing carriages 9 are thus organized relative to the rails 4 guiding the handholds 1 in a manner such that the handholds 1 and the flexible link elements 6 are decelerated in a safety zone C which is adjacent to the downstream end 18 of the device 15.

In the present invention, and as shown diagrammatically in FIGS. 2 to 4, the device 15 is provided with a protection and safety assembly 22 which covers the downstream end 18.

In the safety zone C, the assembly 22 includes: a moving member 23 disposed above the handrail elements 1, 6 and adapted to be entrained by a foreign body 24 itself entrained by said handrail elements 1, 6 in the same direction 21 as and at the same speed as said handrail elements along a substantially horizontal path; and detector means 25 adapted to detect a predetermined displacement of the moving member 23 in the direction 21, and to cause the device 15 and, in general, the moving walkway 16 to stop.

For example, and as shown diagrammatically in FIGS. 2 and 4, the foreign body 24 may be constituted by the hand and the arm of a user (not shown) of the moving walkway 16 hanging onto the handrail elements 1, 6, or else it may be any object fixed in any manner to the handrail elements 1, 6 or constrained to move with them.

Such an intrusion must be detected in order to cause the device 15 and the walkway 16 to stop so as to prevent the user suffering injuries that could be serious.

In the embodiment shown diagrammatically in FIGS. 3 and 4, the moving member 23 is constituted by a carriage 26 equipped on either side with wheels 27 guided by rails 28.

The carriage 26 is upside-down channel section, comprising a web 29 and two side flanges 30 situated respectively above and on either side of the handrail elements 1, 6, and close thereto, so that the carriage 26 is necessarily hit and entrained by a foreign body 24 such as the hand of a user hanging firmly onto the handrail elements.

The detector means 25 are constituted, for example, by any known conventional mechanical, optical, or electrical detector. In the example shown, they are constituted by a safety switch of the limit switch type, adapted to be actuated by the carriage 26 as entrained by a foreign body 24, and to act via a suitable electric circuit to stop the device 15 and the moving walkway 16.

The protection assembly 22 advantageously includes actuator means for causing the carriage 26 entrained by the foreign body 24 at the same speed as said elements 1, 6 to be moved in the direction 21 at a speed higher than the speed of the handrail elements 1, 6.

In the example shown, the actuator means 31 comprise means for exerting a force on the carriage 26, which force is represented diagrammatically by arrow 32 and is directed in the direction 21 in which the handrail elements 1, 6 move.

The assembly 22 also includes brake means (shown diagrammatically at 33) adapted to maintain the carriage 26 in its waiting position against the effect of said force, and to cease their braking action at least in part when a foreign body 24 entrained by the handrail element 1, 6 goes past.

In this example, the actuator means 31 are represented diagrammatically by a counterweight 34 fixed to the bottom end of a cable 35 having a substantially horizontal segment 36 extending from the front end 37 of the carriage 26, in the direction 21, to a deflector pulley 38 beyond which the cable 35 has a vertical run 39 extending downwards to the counterweight 34.

The actuator means 31 may naturally be constituted by equivalent means performing the same function for obtaining the same result, e.g. by mechanical means such as a spring or by pneumatic, hydraulic, or electric means.

The assembly 22 further includes protection means 40 disposed above the member 23 for protecting said member 23 and adapted to open up to allow the foreign body 24 to pass even when it is entrained with some minimum force by the handrail elements 1, 6.

In the example shown, the protection means 40 comprise two elastic lips 41, 42 that are substantially touching and that extend longitudinally above the carriage 26 when they are in their closed position, as shown in FIG. 3. The lips are organized such that the respective adjacent edges 41*a*, 42*a* of said lips 41, 42 can move apart from each other transversely and upwards, as indicated respectively by arrows 43 and 44, into a raised position so as to allow said foreign body 24 to pass, as shown diagrammatically in FIG. 4.

The elastic lips 41 and 42 thus constitute both the above-mentioned brake means 33 and the above-mentioned protection means 40.

When the lips 41, 42 are raised, at least over a portion of their length, by a foreign body 24, they cease their braking action at least in part, so that the carriage 26, pushed by the foreign body 24 and urged by the counterweight 34, moves rapidly in the direction 21 to engage and actuate the detector means 25.

The lips 41, 42 are adapted to close again after the foreign body 24 has gone past.

The lips 41 and 42 extend longitudinally in the direction 21 over a predetermined length L that is sufficient to allow the foreign body 24 to pass over the distance traveled by said foreign body 24 entrained by the handrail elements 1, 6 until the device 15 and the moving walkway 16 have come to a complete stop.

It is easy to dimension the decelerated zone C such that the above-mentioned length L lies substantially completely within said zone C before the start of the downstream acceleration and turn-around zone.

As described above, the protection and safety assembly 22 is thus adapted to be installed above the handrail device 15 in a substantially horizontal portion of said device, and to be actuated to move in the direction 21 in which the handrail elements 1, 6 move, this system being simple in structure and operating very reliably.

The elastic lips constitute a protective gasket capable of opening up in its middle under a small force to clear the way for the foreign body 24, while remaining closed during normal operation.

On either side of the lips 41 and 42, and of the carriage 26, the protection and safety assembly 22 is provided with rigid protective covers shown diagrammatically at 45, 46 in FIGS. 3 and 4.

Downstream from the protection device 22, the assembly 22 also includes a rigid protective cover shown diagrammatically at 47 in FIG. 2, and totally covering the device 15.

Naturally, the present invention is not limited to the above-described embodiments, and numerous changes and modifications may be made to them without going beyond the field of the invention.

It is thus possible to provide protection means 40 that are distinct from the brake means 33.

It is also possible to install a protection and safety assembly 22 on a type of handrail device other than the type described above, in particular on a handrail device that moves at uniform speed, without any safety zone.

What is claimed is:

1. A handrail-forming device for a high-speed moving walkway or the like, said device being accelerated and decelerated respectively at its upstream end and at its downstream end, said device including handrail elements organized in a manner such that the visible handrail elements which constitute the top run of the device and which are moved in the downstream direction, are moved at a decelerated speed in a decelerated safety zone which is situated upstream from and in the vicinity of the downstream end of said device, said device including a protection and safety assembly which covers the downstream end of said device and which, in said decelerated safety zone, includes a moving member disposed above said handrail elements and adapted to be entrained by a foreign body itself entrained by said handrail elements in the same direction as and at the same speed as said handrail elements along a substantially horizontal path, and detector means adapted to detect predetermined displacement of said member in said direction, and to cause at least said device to stop, wherein said assembly includes actuator means for causing said member as entrained in this way by a foreign body to be moved in said direction at a speed higher than the speed of said foreign body.

2. The device according to claim 1 wherein said actuator means comprise means for exerting a force on the moving member in the direction in which the handrail elements move, the assembly also including brake means adapted to maintain said member in its waiting position against the effect of said force, and to cease their braking action at least in part when a foreign body entrained by the handrail elements goes past.

3. The device according to claim 2, wherein the actuator means for exerting a force on the moving member are, for example, mechanical means such as a counterweight or a spring, pneumatic, hydraulic, or electric means.

4. A handrail-forming device for a high-speed moving walkway or the like, said device being accelerated and decelerated respectively at its upstream end and at its downstream end, said device including handrail elements organized in a manner such that the visible handrail elements which constitute the top run of the device and which are moved in the downstream direction, are moved at a decelerated speed in a decelerated safety zone which is situated upstream from and in the vicinity of the downstream end of said device, said device including a protection and safety assembly which covers the downstream end of said device and which, in said decelerated safety zone, includes a moving member disposed above said handrail elements and adapted to be entrained by a foreign body itself entrained by said handrail elements in the same direction as and at the same speed as said handrail elements along a substantially horizontal path, and detector means adapted to detect predetermined displacement of said member in said direction, and to cause at least said device to stop, wherein said assembly includes protection means disposed above said member to protect said member, and adapted to open up to allow said foreign body to pass through when it is entrained with some minimum force by said handrail elements.

5. The device according to claim 4, wherein said protection means are adapted to close up again after said foreign body has gone past.

6. The device according to claim 4, wherein said protection means extend longitudinally over a predetermined length that is sufficient to allow the foreign body to pass over the distance traveled by said foreign body until at least said device has come to a complete stop.

7. The device according to claim 4, wherein said protection means comprise two elastic lips that are substantially touching, extending longitudinally above said member in their closed position, and that are organized such that the respective adjacent edges of said two lips can move apart from each other transversely and upwards into a raised position to allow said foreign body to go past.

8. The device according to claim 7, wherein the elastic lips are in their closed position in contact with said member and they maintain it in its waiting position in the manner of a brake, the braking action ceasing when the lips are in a raised position.

9. The device according to claim 1, wherein the handrail elements comprise handholds, each of which is mounted on a respective carriage whose wheels move between first rails, and flexible link elements, each of which interconnects two successive carriages while passing over deflector members carried by the carriages, the two ends of each flexible link element being connected to respective ones of two adjacent backing carriages that move along second rails at varying distance from the first rails.

* * * * *